United States Patent [19]

Pounds

[11] 4,421,966

[45] * Dec. 20, 1983

[54] KEYBOARD ELASTOMERIC COVER WITH BUTTONS HAVING CHANGEABLE LEGENDS

[75] Inventor: Walter R. Pounds, Lafayette, Colo.

[73] Assignee: KB Denver, Inc., Frederick, Colo.

[ * ] Notice: The portion of the term of this patent subsequent to Oct. 5, 1999 has been disclaimed.

[21] Appl. No.: 401,657

[22] Filed: Jul. 26, 1982

[51] Int. Cl.[3] ..... H01H 9/04

[52] U.S. Cl. ..... 200/309; 200/159 B; 200/5 A

[58] Field of Search ..... 200/309, 159 B, 5 A, 200/340, 302

[56] References Cited

U.S. PATENT DOCUMENTS

| | | | |
|---|---|---|---|
| 3,024,337 | 3/1962 | Goudy et al. | 200/302 |
| 3,996,441 | 12/1976 | Ohashi | 200/309 |
| 4,029,924 | 6/1977 | Frank et al. | 200/340 X |
| 4,046,975 | 9/1977 | Seeger, Jr. | 200/302 X |
| 4,066,851 | 1/1978 | White et al. | 200/340 X |
| 4,145,584 | 3/1979 | Otterlei | 200/159 B X |
| 4,298,778 | 11/1981 | Beresford-Jones | 200/302 |
| 4,302,647 | 11/1981 | Kondler et al. | 200/5 A X |
| 4,315,114 | 2/1982 | Monti, Jr. | 200/159 B X |
| 4,352,968 | 10/1982 | Pounds | 200/302 |

OTHER PUBLICATIONS

Johnson, Jr., *Keyboard and Wiping Contact Assembly,* Dec. 1970, vol. 13, IBM Technical Disclosure, pp. 1962–1963.

*Primary Examiner*—James E. Bryant, III
*Assistant Examiner*—Renee S. Kidorf
*Attorney, Agent, or Firm*—Lloyd L. Zickert

[57] ABSTRACT

A keyboard elastomeric cover which includes buttons or keys having changeable legends, sealing means for sealing the cover to a switch subassembly and alignment bosses or posts coacting with the subassembly to maintain proper alignment between the buttons or keys and the switches on the subassembly.

12 Claims, 5 Drawing Figures

4
4
40
40a
41
41a
42
42a
50
10
11
12
13
16
17
18
19
20
21
22
23
24
28
29
30
31
32
35
36
46
47
48
51

KEYBOARD ELASTOMERIC COVER WITH BUTTONS HAVING CHANGEABLE LEGENDS

This invention relates in general to a keyboard, and more particularly to a keyboard having an elastomeric cover coacting with a switch subassembly wherein the cover includes integrally formed buttons and keys coacting with switches on the switch subassembly and seal means for sealing the switch subassembly against contaminants when mounted on a panel.

BACKGROUND AND SUMMARY OF THE INVENTION

This invention is an improvement over my invention disclosed in my copending patent application Ser. No. 232,918, filed Feb. 9, 1981, now Pat. No. 4,352,968 and entitled "Elastomeric Boot for a Keyboard Subassembly." The present invention differs from that in my copending application in that the elastomeric cover includes alignment bosses or posts coacting with the switch subassembly to assure proper alignment between the buttons or keys on the cover and the switches on the switch subassembly, and further in that the keys or buttons are structured so that the legends or indicia identifying each button or key may be selectively changed. Legend changing is accomplished by structuring the buttons or keys with sockets for matingly receiving legend inserts or plates having selected indicia or legends imprinted or otherwise applied thereto. Additionally, the cover includes an integrally formed O-ring to provide a better seal between the cover and a panel on which the keyboard is mounted.

It is therefore an object of the present invention to provide an improved elastomeric cover for a keyboard switch subassembly where the cover seals the subassembly against contaminants and includes alignment bosses or posts for maintaining proper alignment between buttons or keys integrally formed in the cover and switches on the switch subassembly.

A further object of the present invention is in the provision of providing an elastomeric cover having integrally formed buttons or keys with changeable legends.

A still further object of the present invention is in the provision of an elastomeric cover for a keyboard switch subassembly which fully seals the switch subassembly against liquid or solid contaminants and which has integrally formed an O-ring seal, thereby protecting the switch subassembly against contamination by water or other liquids, greases or oils, dusts or other solids so that the keyboard may be used in environments normally detrimental to keyboards.

Other objects, features and advantages of the invention will be apparent from the following detailed disclosure, taken in conjunction with the accompanying sheets of drawings, wherein like reference numerals refer to like parts, in which:

DESCRIPTION OF THE PREFERRED EMBODIMENTS

Figure 1:
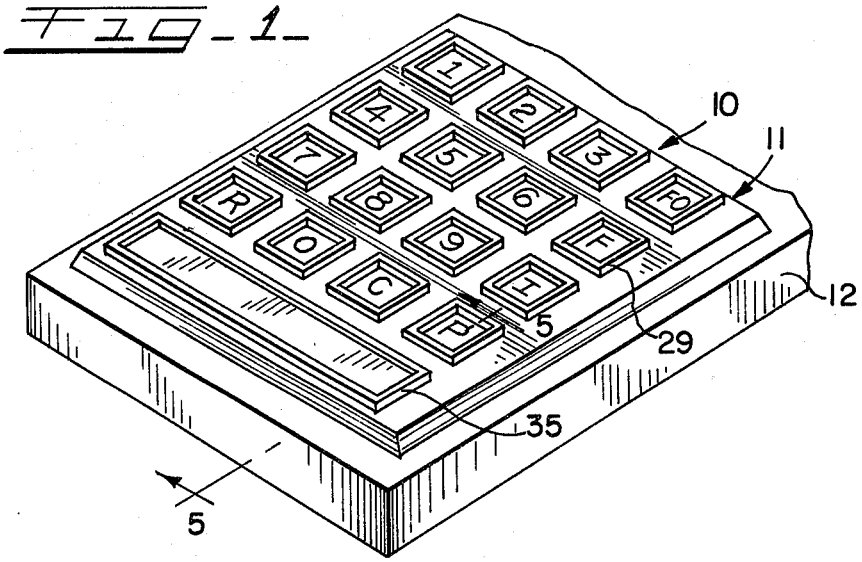
FIG. 1 is a perspective view of a keyboard assembly according to the present invention in mounted relation on a panel.
Figure 2:
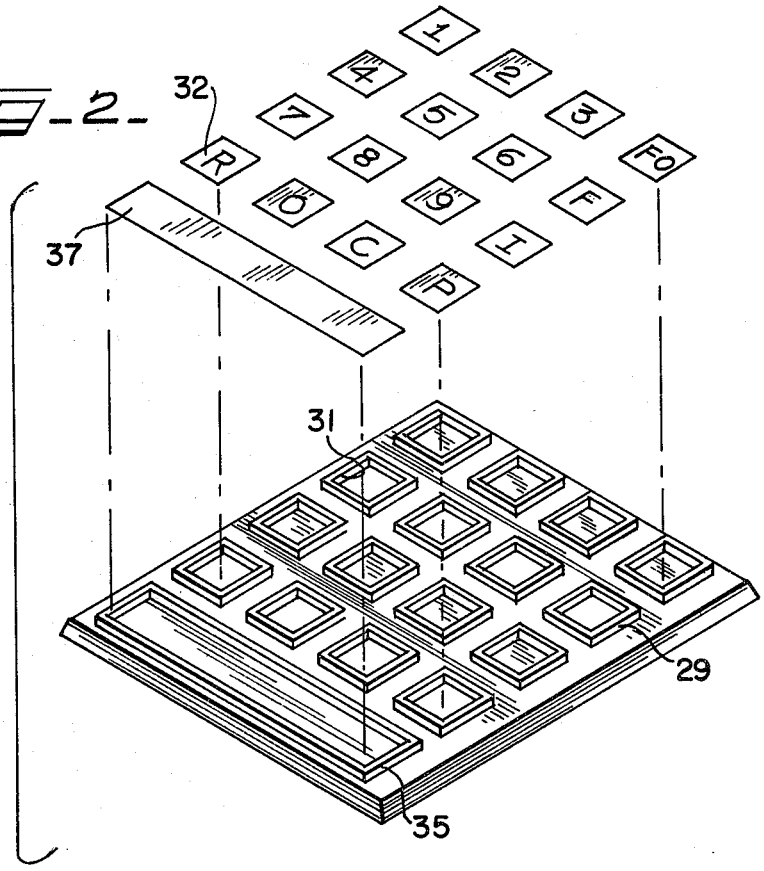
FIG. 2 is an exploded perspective view of an elastomeric cover according to the invention illustrating the manner in which legends may be changed.
Figures 3, 4, 5:
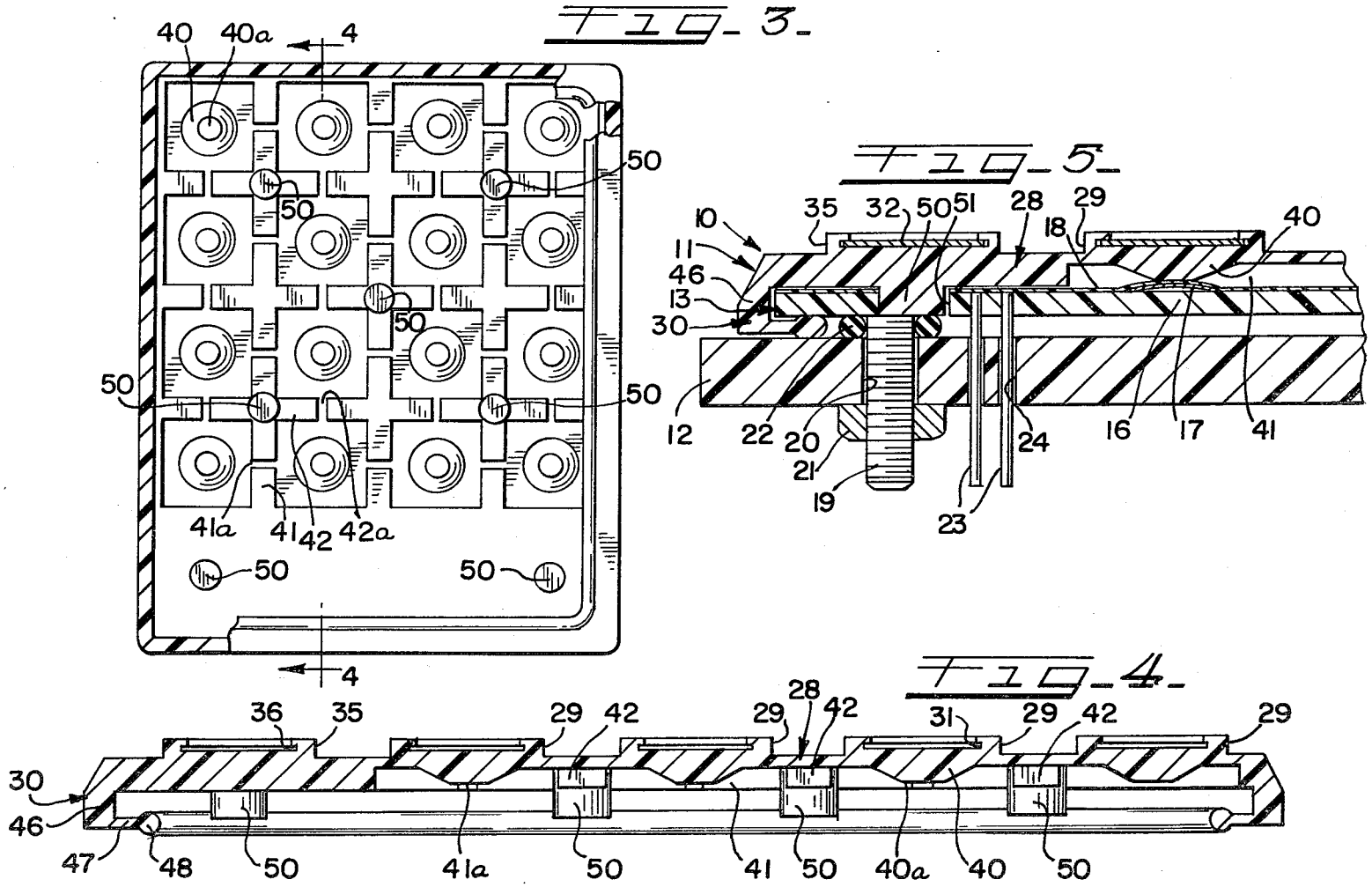
FIG. 3 is a bottom plan view of the elastomeric cover of the invention with some parts broken away to show underlying parts.
FIG. 4 is a longitudinal sectional view of the elastomeric cover taken substantially along line 4—4 of FIG. 3.
FIG. 5 is an enlarged fragmentary sectional view of the keyboard assembly taken substantially along line 5—5 of FIG. 1.

Referring now to the drawings and particularly to FIGS. 1 and 5, a keyboard assembly or keyboard 10 having the elastomeric or boot 11 of the invention is illustrated in mounted relation on a panel 12. The cover 11 encloses a switch subassembly 13 and seals it to the panel against environmental contamination.

The switch subassembly 13 includes a printed circuitboard 16 with a plurality of conductive paths and switch sites thereon, the details of which are not shown. Domes or dome switches 17 at each switch site and a sheet or film 18 of suitable insulating material, such as Mylar, overlies and adhesively adheres to the printed circuit board and the domes, thereby maintaining the domes in alignment with the switch sites and insulating the conductive paths from other parts of the keyboard assembly, such as particularly illustrated in U.S. Pat. No. 3,967,084 and as somewhat shown in my abovementioned copending application.

The printed circuit board also includes a plurality of threaded studs 19 extending from the bottom face of the board and at suitable locations for securing the keyboard to a panel in the manner illustrated in FIG. 5 where the stud extends through a hole 20 in the panel and receives a nut 21 for engagement with the backside of the panel to draw the assembly tightly to the panel. Where it may be desirable to seal along the threaded studs with respect to the panel, O-ring gaskets 22 may be provided at each stud and positioned between the printed circuit board and the panel, as shown in FIG. 5.

It may be further appreciated that conductors in the form of pins 23 of any suitable number will be mounted to the printed circuitboard and suitably connected to the conductive paths thereon for further connection to circuitry in which the keyboard assembly is used. These pins would extend through holes formed in the panel so that they could be hereafter connected to the circuitry. Suitable sealing means may also be provided with respect to the pins if desired to prevent contaminants coming through the pin openings 24 in the panel. However, it should be appreciated that the present invention is primarily concerned with preventing contamination of the switch subassembly by virtue of the keyboard assembly being exposed to adverse environmental conditions as the panel on which the keyboard is mounted would normally be part of a closed housing or structure for electrical circuitry and components operated by the keyboard.

The elastomeric cover 11 includes generally a panel portion 28 having a plurality of buttons or keys 29 and a peripheral portion 30 overlying the edges of the switch subassembly and sealing it to the panel 12.

The cover may be constructed of any suitable elastomeric material such as natural or synthetic rubber, resilient plastic or the like, such that it will have the capability of providing the desired flexibility and sealing qualities as well as being able to withstand the environmental conditions in which it is to be used. Silicone rubber has been found to be satisfactory for most applications. As such, it is impervious to contaminants as well as being an electrical insulator for the subassembly. It should be further appreciated that the cover 11 is a one-piece or unitary structure of suitable elastomeric material and shaped to cover the entire upper face of the switch subassembly as well as the opposed edges.

Each button 29 includes a socket 31 for removably receiving a changeable legend or indicia insert or plate 32. The socket 31 of each button is in the form of a continuous undercut or slot which matingly receives in retained position a legend insert or plate. While the buttons are illustrated as being square in shape, it should be appreciated that they may by of any suitable geometric shape . For example, they may be circular in shape or of any other polygonal shape. The inserts 32 may be of any suitable material having sufficient rigidity to be insertable in the sockets of the buttons, it being appreciated the sockets are readily deformable and stretchable to allow insertion of inserts. While the buttons are shown to be projecting upwardly from the upper surface of the cover panel portion 28, it may also be appreciated that they could be made substantially flush if desired. For example, the inserts may be made of any suitable plastic.

An elongated keyboard identification portion 35 constructed like the buttons 29 and including a socket 36 for matingly receiving an elongated identification insert or plate 37 of a size to fit in the socket is shown at the bottom of the buttons 29 on the panel portion 28. It will be appreciated that the insert 37 may be used to write in identification indicia for the keyboard or to have suitably applied thereto indicia for identifying the keyboard and any functions or instructions therefor. The insert 37 is also changeable as are the legend inserts for the buttons. It should be appreciated that the identification portion may be optionally used and that some keyboards may not even include this portion.

While the cover 11 is shown to include 16 buttons, it will be appreciated that any suitable number may be provided. By virtue of having changeable inserts, the indicia or legends on the inserts may be easily changed so that the cover may be standardized and used for any suitable keyboard application.

In alignment with the buttons 29 on the underside of the panel portion 28 are dome actuating portions 40 of a generally inverted frusto-conical shape so as to have a substantially flattened portion 40a which engages the dome switch in alignment therewith. Thus, upon depressing of a button, a force is applied through the button to the dome actuating portion and to the dome aligned therewith for effecting a switching operation at that site on the printed circuit board.

Also provided on the underside of the panel portion is an egg-crate structure including vertically and horizontally extending bars 41 and 42, as seen in FIG. 3, which are disposed between the dome actuating portions and which engage the upper surface of the switch subassembly when assembled therewith. The bars reinforce the panel portion and importantly serve to prevent crossover action between buttons during their actuation to prevent activation of a dome adjacent to a dome being activated by a corresponding button especially in the event that a button or key is depressed with an off-center force. Inasmuch as the bars engage the upper surface of the switch subassembly and it is important to prevent the trapping of air in an area of a single button actuating portion, air passage means is provided between all of the areas of the dome actuating portions by means of gaps 41*a* and 42*a* in the vertical and horizontal bars 41 and 42.

The peripheral portion 30 includes a vertically extending wall portion 46 which extends along the peripheral edge of the switch subassembly, an inwardly extending lip portion 47 disposable between the prined circuitboard of the switch subassembly and the panel 12, and an O-ring portion 48. It therefore can be appreciated upon mounting of the cover on the switch subassembly and then mounting of the keyboard onto a panel as shown in FIG. 5, the O-ring portion 48 will provide a positive seal around the periphery of the cover between th printed circuit board of the switch and subassembly and the panel 12 on which the keyboard is mounted.

To further maintain proper alignment between the buttons and their respective dome actuating portions and the domes on the switch subassembly, a plurality of alignment bosses or posts 50 extend from the underside of the panel portion 28 and engage in holes 51 formed in the switch subassembly as particularly seen in FIG. 5. Any number of bosses or posts may be used although there are seven shown in FIG. 3 and which are arranged to provide the desired alignment function over the entire cover.

It will be understood that modifications and variations may be effected without departing from the scope of the novel concepts of the present invention, but it is understood that this application is to be limited only by the scope of the appended claims.

The invention is hereby claimed as follows:

1. In a keyboard assembly having a printed circuit board with conductive paths and dome switches coacting with said paths, and a cover member for said board, wherein said board includes fastening means for mounting the assembly on a support panel, the improvement being in the cover member which comprises an elastomeric boot overlying the board and sealing said board to said support panel against the entry of contaminants, said boot having coacting button and dome actuating portions aligned with said dome switches, sealing means disposed peripherally of the board and between the board and panel, and alignemnt bosses matingly received in sockets formed in the board to maintain the dome actuating portions in alignment with said dome switches.

2. The improvement of claim 1, wherein said button portions include changeable legend plates that may be easily removed and replaced.

3. The improvement of claim 2, wherein said dome actuating portions include flattened tip dome depression means engaging the dome switches for transmitting forces from depressed button portions through the actuating portions to aligned dome switches.

4. The improvement of claim 3, wherein said boot further includes bar means between each of the dome actuating portions and engaging the board for reinforcing the boot and preventing crossover movement between adjacent button portions.

5. The improvement of claim 4, wherein said bar means includes air passage means for the free movement of air between eah area around a dome actuating portion.

6. The improvement of claim 5, wherein said sealing means includes a continuous O-ring portion that sealingly engages between the support panel and the board upon tightening of the fastening means.

7. The improvement of claim 1, wherein said button portions include socket means and overlay inserts, wherein the inserts are removably received by said socket means.

8. In a keyboard having a printed circuit board with conductive paths and dome switches coacting with said paths, and a cover member for said board, wherein said board includes fastening means for mounting the assembly on a support panel, the improvment being in the cover member which includes a body of elastomeric material coacting with the board having means for actuating said dome switches and means for sealing the board to the panel against contaminants, said body having a panel portion in parallel spaced relation to said board and a peripheral portion engaging the edges of the board and extending between the board and the support panel, said panel portion having buttons and dome actuating portions aligned with said dome switches and a plurality of alignment bosses or posts matingly received in openings formed in the board to maintain the dome actuating portions in alignment with said dome switches, and said peripheral portion having O-ring sealing means disposed between the board and the panel.

9. The improvement defined by claim 8, wherein said buttons include socket means for interchangeably receiving legend inserts.

10. The improvement defined by claim 9, wherein said body further includes bar means facing and engaging said board and disposed between said dome actuating portions for preventing the transmittal of crossover forces between adjacent buttons, and said bar means having air passage means to permit the free movement of air between each area around a dome actuating portion.

11. A keyboard cover for a switch subassembly having a plurality of dome switches on a printed circuit board, said cover comprising a one-piece body of elastomeric material having a panel portion disposed in parallel relation to said printed circuit board and a peripheral portion extending over and under the periphery of said board, said panel portion including a plurality of combination button-dome actuating portions, one for each dome switch and in alignment therewith, each dome actuating portion being on the side of the panel portion facing said board and in engagement with a dome switch for actuating same, each button being on the other side of the panel portion and having a socket means for removably receiving a changeable legend insert, and seal means on said peripheral portion for sealing the switch subassembly to a support panel against environmental contamination.

12. The keyboard cover defined in claim 11, which further includes means extending from the board facing side and coacting with the board to maintain the dome actuating portions in alignment with said dome switches.

* * * * *

UNITED STATES PATENT AND TRADEMARK OFFICE

CERTIFICATE OF CORRECTION

PATENT NO. : 4,421,966

DATED : December 20, 1983

INVENTOR(S) : Walter R. Pounds

It is certified that error appears in the above—identified patent and that said Letters Patent is hereby corrected as shown below:

Col. 4, line 15, change "th" to --the--;

line 65, change "eah" to --each--; and

Col. 5, line 7, after "keyboard" insert --assembly--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*